US006042694A

United States Patent [19]

Brox

[11] Patent Number: 6,042,694

[45] Date of Patent: Mar. 28, 2000

[54] SHOE PRESS

[75] Inventor: Erik Brox, Forshaga, Sweden

[73] Assignee: Valmet-Karlstad AB, Karlstad, Sweden

[21] Appl. No.: 09/163,727

[22] Filed: Sep. 30, 1998

Related U.S. Application Data

[60] Provisional application No. 60/064,811, Nov. 7, 1997.

[51] Int. Cl.[7] ..... D21F 3/00; D21H 11/00; B31F 1/07; B30B 3/00

[52] U.S. Cl. ..... 162/358.3; 162/358.1; 162/361; 492/20; 100/153

[58] Field of Search ..... 162/358.3, 358.4, 162/358.5, 361, 358.1; 492/20; 100/153, 162 B

[56] References Cited

U.S. PATENT DOCUMENTS 5,676,799 10/1997 Meschenmoser et al. .

FOREIGN PATENT DOCUMENTS 0 345 501 12/1989 European Pat. Off. .

19515832C1 5/1996 Germany .

*Primary Examiner*—Peter Chin
*Assistant Examiner*—Dionne A. Walls
*Attorney, Agent, or Firm*—Alston & Bird LLP

[57] ABSTRACT

A shoe press for paper or board machines comprises a press shoe; a counter roll; the press shoe and the counter roll forming between themselves an extended nip for a paper or cardboard web and a circulated flexible belt; and at least one hydraulic loading cylinder for pressing the press shoe against the counter roll. Hydrostatic pockets are arranged in the side of the press shoe facing the counter roll and hydrostatic compartments are formed between the opposite side of the press shoe and the loading cylinders, the pockets and compartment being adapted to be supplied with hydraulic fluid. At least one pipe for supplying hydraulic fluid to the compartments and/or pockets is releasably attached to one side of the press shoe in the longitudinal direction thereof, and the pipe has through holes in its wall, which holes each communicate with a duct at one end thereof, the ducts being formed in the press shoe. The ducts open at their other ends into working chambers in the loading cylinders and/or into the hydrostatic compartments and/or into the hydrostatic pockets.

21 Claims, 4 Drawing Sheets

SHOE PRESS

CROSS-REFERENCE TO RELATED APPLICATION

This application claims priority to U.S. Provisional Patent Application Serial No. 60/064,811 filed Nov. 7, 1997.

FIELD OF THE INVENTION

The present invention relates to a shoe press for paper machines, board machines, or the like.

BACKGROUND OF THE INVENTION

Shoe presses generally comprise a press shoe and a counter roll which form an extended nip therebetween through which a running fibrous web is carried for treating the web, such as for dewatering the web in the press section of a paper machine. Shoe presses generally also comprise pressure-actuatable piston-and-cylinder units, also referred to as loading cylinders, which are distributed along the press shoe in one or more rows in the longitudinal direction of the press shoe and adapted to press the press shoe against the counter roll. For example, EP 345 501 B2, DE-195 15 832 C1, and DE-44 09 316 C1all show shoe presses of the type described above.

Some shoe presses also include pockets or compartments arranged in the press shoe surface facing the counter roll, the compartments in operation being supplied with fluid under hydrostatic pressure for lubricating the belt, as shown for example in EP-345 501 B2.

Moreover shoe presses may comprise a compartment or pressure chamber between each loading cylinder and the press shoe, which may be open towards the press shoe and in operation be supplied with fluid under hydrostatic pressure. The pressure chamber acts to transmit the pressure of the loading cylinder to the press shoe and to form a hydraulic fluid pad, as disclosed for example in DE-195 15 832 C1.

These loading cylinders, compartments, and pockets require access to hydraulic fluid. Various designs have been developed for delivering hydraulic fluid to the working chambers of loading cylinders, to hydrostatic pockets in a press shoe surface for belt lubrication, and to hydrostatic compartments between loading cylinders and a press shoe. For example, EP-345 501 B2 discloses a shoe press in which the pockets in the press shoe surface facing the counter roll are pressurized by hydraulic fluid through a main duct which is common to all the pockets and is bored through the frame system of the shoe press in the longitudinal direction (i.e., cross-machine direction) of the shoe press. A plurality of individual ducts bored in the frame connect the main duct to each pocket, each of the individual ducts including a portion which serves as a throttle. The throttle serves the purpose of making the pressure condition of each pocket essentially independent of the pressure conditions of the other pockets. EP-345 501 B2 also discloses that the loading cylinders are pressurized by hydraulic fluid via additional ducts bored in the frame system of the shoe press.

Similarly, DE-195 15 832 C1 also discloses a shoe press in which ducts are bored in the frame system of the shoe press for supplying hydraulic fluid to the loading cylinders as well as for pressurizing the pressure chambers between the press shoe and the loading cylinders. A piston member of each loading cylinder includes an opening or throttle for passing fluid from the working chamber of the loading cylinder into the pressure chamber.

The frame system of a shoe press is typically formed of relatively massive members, for example steel beams.

Accordingly, boring ducts through the frame system for supplying hydraulic fluid to the various chambers and compartments is a complicated and expensive procedure. Additionally, the fixed geometry of the ducts does not readily allow for varying the flow characteristics, for example where it is desired to change the relative proportions of flow supplied to various ones of several chambers or compartments.

SUMMARY OF THE INVENTION

The present invention overcomes the drawbacks associated with prior shoe presses noted above, by providing a shoe press in which hydraulic fluid is supplied to the loading cylinders, compartments, and/or chambers via supply members or pipes which are releasably attached to the press shoe and which communicate with the various chambers and compartments by ducts formed in the press shoe, or which directly communicate with a compartment, without the necessity of forming bores in the frame system of the shoe press.

To these ends, a preferred embodiment of a shoe press in accordance with the invention comprises a press shoe having a plurality of sides including a first side adapted to coact with the counter roll to form an extended nip therebetween through which the running web is carried, and at least one hydraulic loading cylinder adjacent a second side of the press shoe and operable for pressing the press shoe against the counter roll. The shoe press also includes at least one hydrostatic compartment formed between the second side of the press shoe and each loading cylinder and adapted to be supplied with hydraulic fluid from a hydraulic fluid source. Fluid is supplied to the hydrostatic compartment or compartments via a duct or ducts formed in the press shoe. Preferably, at least one pipe is releasably attached to one of the sides of the press shoe, the pipe having at least one hole through a side wall thereof, and one end of the duct communicates with the hole in the pipe wall and an opposite end of the duct opens into one of the hydrostatic compartments.

In accordance with one preferred embodiment of the invention, the pipe is releasably attached to a side edge of the press shoe extending in a cross-machine direction. In one embodiment there are a plurality of loading cylinders spaced in a cross-machine direction along the press shoe and a corresponding plurality of hydrostatic compartments each formed between the second side of the press shoe and each loading cylinder. The pipe extends along the press shoe in the cross-machine direction and includes a plurality of holes through the side wall spaced in the cross-machine direction, and the press shoe includes a plurality of ducts each establishing fluid communication between one of the holes in the pipe and one of the hydrostatic compartments.

Advantageously, the hole in the pipe, or each hole where there are more than one, comprises a throttle for regulating flow through the duct. Thus, changing the throttle dimension can easily be accomplished by replacing the pipe with a different pipe having a different throttle dimension.

In accordance with another preferred embodiment of the invention, the loading cylinder includes a working chamber, and a duct in the press shoe connects the hole in the pipe side wall with the working chamber of the loading cylinder. In one embodiment, the working chamber is formed by a recess in the second side of the press shoe, and the duct in the press shoe opens into the recess for supplying fluid to the working chamber.

In accordance with yet another preferred embodiment of the invention, the first side of the press shoe facing the counter roll includes at least one hydrostatic pocket formed therein, and at least one hydrostatic compartment is formed between the loading cylinder and the second side of the press shoe. The pipe has two bores, one of the bores communicating with the hydrostatic pocket in the first side of the press shoe facing the counter roll and the other bore communicating with the hydrostatic compartment between the loading cylinder and the press shoe. Advantageously, the pipe is at least partially disposed in a recess formed in the second side of the press shoe.

The invention thus enables a number of advantages to be realized over prior shoe presses. For example, pipes can be made in a less expensive fashion than precision-bored ducts in frame parts. Additionally, it is easy and relatively inexpensive to modify a shoe press in accordance with the invention, for instance for changing the throttle dimensions.

BRIEF DESCRIPTION OF THE DRAWINGS

Embodiments of the invention will now be described in more detail with reference to the accompanying drawings, in which.

DETAILED DESCRIPTION OF PREFERRED EMBODIMENTS

The invention is now explained by reference to certain preferred embodiments thereof. It is to be understood, however, that the present invention can be embodied in many different forms and should not be construed as being limited to the embodiments described herein; rather, these embodiments are presented so that this disclosure will be thorough and complete and will fully convey the scope of the invention to those skilled in the art. Like numbers refer to like elements throughout.

All Figures are cross-sectional views of the shoe press parts which are essential to the understanding of the invention, it being understood that the press shoe is a single piece extending longitudinally in the cross-machine direction, whereas the loading cylinders, compartments, and pressure chambers are preferably several, distributed in the longitudinal direction of the press shoe.

Figure 1:
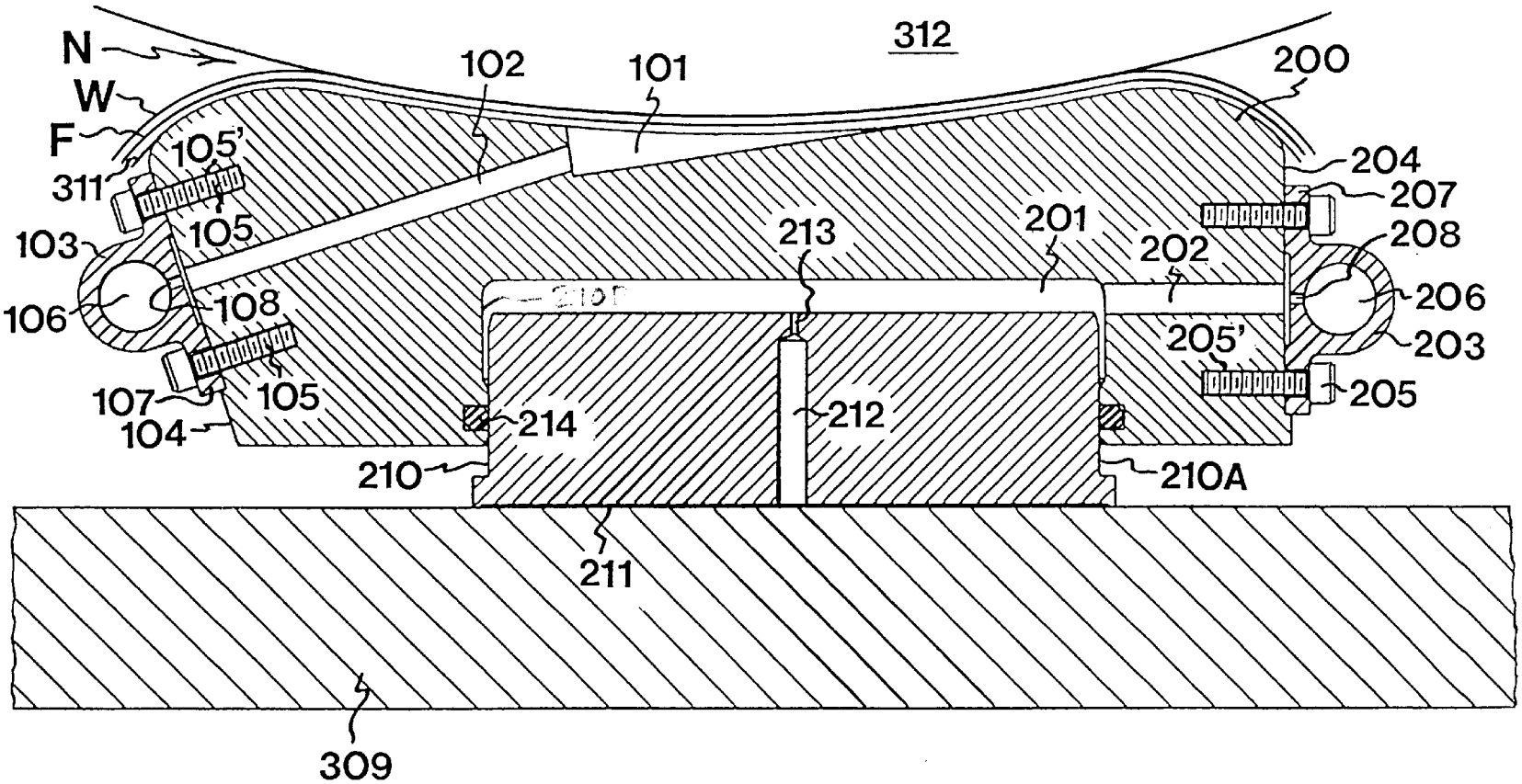
FIG. 1 is a cross-sectional view of a first preferred embodiment of a shoe press in accordance with the invention having a pair of pipes releasably attached to opposite side edges of the press shoe for supplying fluid to a hydrostatic compartment between the press shoe and counter roll and to the working chamber of the loading cylinder.

Reference is first made to FIG. 1 which shows a first preferred embodiment of a shoe press in accordance with the invention having a pair of pipes releasably attached to opposite side edges of the press shoe for supplying fluid to hydrostatic compartments between the press shoe and counter roll and to the working chambers of the loading cylinders. The hydrostatic compartments 101 are pressurizable with hydraulic fluid such that the full force exerted by the loading cylinders on the press shoe is not exerted by metal-to-metal contact between the loading cylinder and shoe, but rather is partially transmitted by fluid pressure. Accordingly, sliding frictional forces between the loading cylinder and the press shoe are reduced, facilitating relative sliding motion therebetween which may occur through thermal expansion during operation as well as through movement of the shoe against a downstream stop when the shoe press is started and frictional forces are exerted on the shoe by the belt traveling through the nip.

The hydrostatic compartments 101 are arranged in a row in the upper side of the press shoe 200 and are each by means of a duct 102 bored in the press shoe 200 connected to a sectional pipe 103 which is releasably attached to one longitudinal side edge 104 (in this case, the inlet side) of the press shoe by means of screws 105 which engage in threaded holes 105' in the press shoe. The duct of the sectional pipe 103 which is intended for hydraulic fluid supply is designated 106, and the attachment of the sectional pipe to the press shoe is carried out by means of sectional pipe flanges 107. The duct 106 is connected to the ducts 102 by means of a throttle 108 which is formed by a hole in the wall of the sectional pipe 103.

The screws 105 thus permit removal of the sectional pipe 103 from the press shoe 200, and also permit mounting of a different sectional pipe 103 on the press shoe 200, for example a pipe having a throttle 108 of different diameter, or a pipe made of a different material.

According to FIG. 1, the working chamber 201 of the loading cylinders 210 is also supplied with hydraulic fluid from a sectional pipe 203 containing a duct 206, which is connected with ducts 202 which are bored in the press shoe 200 and which extend to their working chambers 201. The sectional pipe 203 is releasably attached to one longitudinal side edge 204 (in this case, the outlet side) of the press shoe 200 by means of screws 205. The wall of the sectional pipe 203 has a bored hole or throttle 208 for each duct 202. Also in this case, the screws 205 are screwed into sectional pipe flanges 207 which mate with threaded holes 205' in the press shoe.

The counter roll 312 and shoe 200 form an extended nip N therebetween for the passage of a web W of paper or cardboard together with a flexible circulated belt 311 and, where the shoe press is used in a press section of a paper machine, at least one felt F. The shoe press frame is designated 309.

According to the embodiment in FIG. 1, there is also a hydrostatic compartment or pressure chamber 211 between the frame 309 and the loading cylinder 210, more specifically between the piston 210A of the loading cylinder and the frame. This pressure chamber 211 communicates with the working chamber 201 via a duct 212 with a throttle 213. Thus, the duct 206 in the pipe 203 also supplies the pressure chamber 211 with hydraulic fluid. A sealing O-ring 214 seals the interface between the piston 210A and the cylinder of the loading cylinder, which is formed by a recess 210B in the underside of the press shoe.

Figure 2:
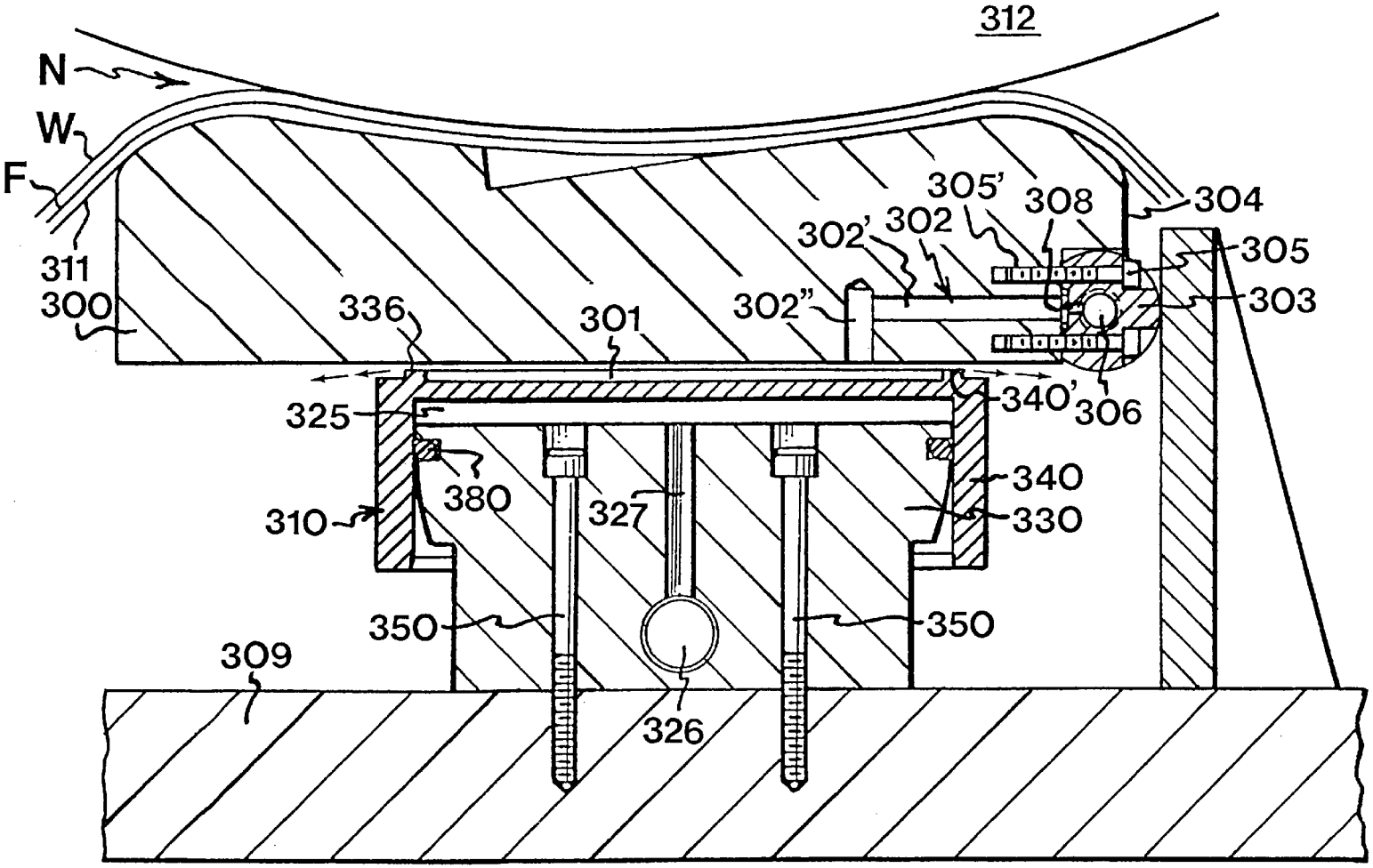
FIG. 2 is a cross-sectional view of a second preferred embodiment of the invention, showing a shoe press in which fluid is supplied from a pipe to a hydrostatic pocket formed between the press shoe and the loading cylinder.

FIG. 2 illustrates a second preferred embodiment of the invention which hydraulic fluid is supplied to a pressure chamber or hydrostatic compartment 301 between a loading cylinder 310 and the press shoe 300. A pipe 303 is releasably attached to a downstream side of the press shoe 300. A hole 308 in the side wall of the pipe 303 forms a throttle from the hydraulic fluid conducting duct 306 of the pipe 303, and a duct 302 formed by duct portions 302' and 302" bored in the press shoe 300 connects the duct 306 and the hydraulic fluid chamber 301 with each other via the throttle 308. The releasable connection between the sectional pipe 303 and the press shoe 300 is illustrated by the screw/screw hole joints 305, 305'.

A loading cylinder 310 is disposed between the press frame 309 and the shoe 300 and includes a piston 330 affixed to the frame 309, for example by screws 350, and a cylinder 340 which slidably receives the piston 330 and forms a working chamber 325 between the cylinder 340 and the piston 330. The working chamber 325 is sealed by a sealing ring 380 retained between the piston 330 and the inner wall of the cylinder 340. A duct 326 bored in the piston 330 in the cross-machine direction is connected to the working chamber 325 by a duct 327 which is bored through the piston 330 in the loading direction (i.e., the direction generally from the frame 309 toward the counter roll 312). Thus, hydraulic fluid is supplied to the working chamber 325 through the ducts 326 and 327.

The hydrostatic compartment 301 between the end face of the cylinder 340 and the press shoe 300 is supplied with hydraulic fluid by the pipe 303 and the ducts 302' and 302" in the shoe 300, as previously described. Advantageously but not necessarily, fluid may be supplied to the compartment 301 at a rate and pressure sufficient to cause the shoe 300 to be lifted away from the annular surface 340' of the cylinder 340 which at rest abuts the shoe 300, such that a gap 336 is created between the cylinder 340 and the shoe 300. Thus, fluid continually flows through the gap 336 as indicated by arrows in FIG. 2, thereby creating a fluid bearing which floatingly supports the press shoe 300.

Figure 3:
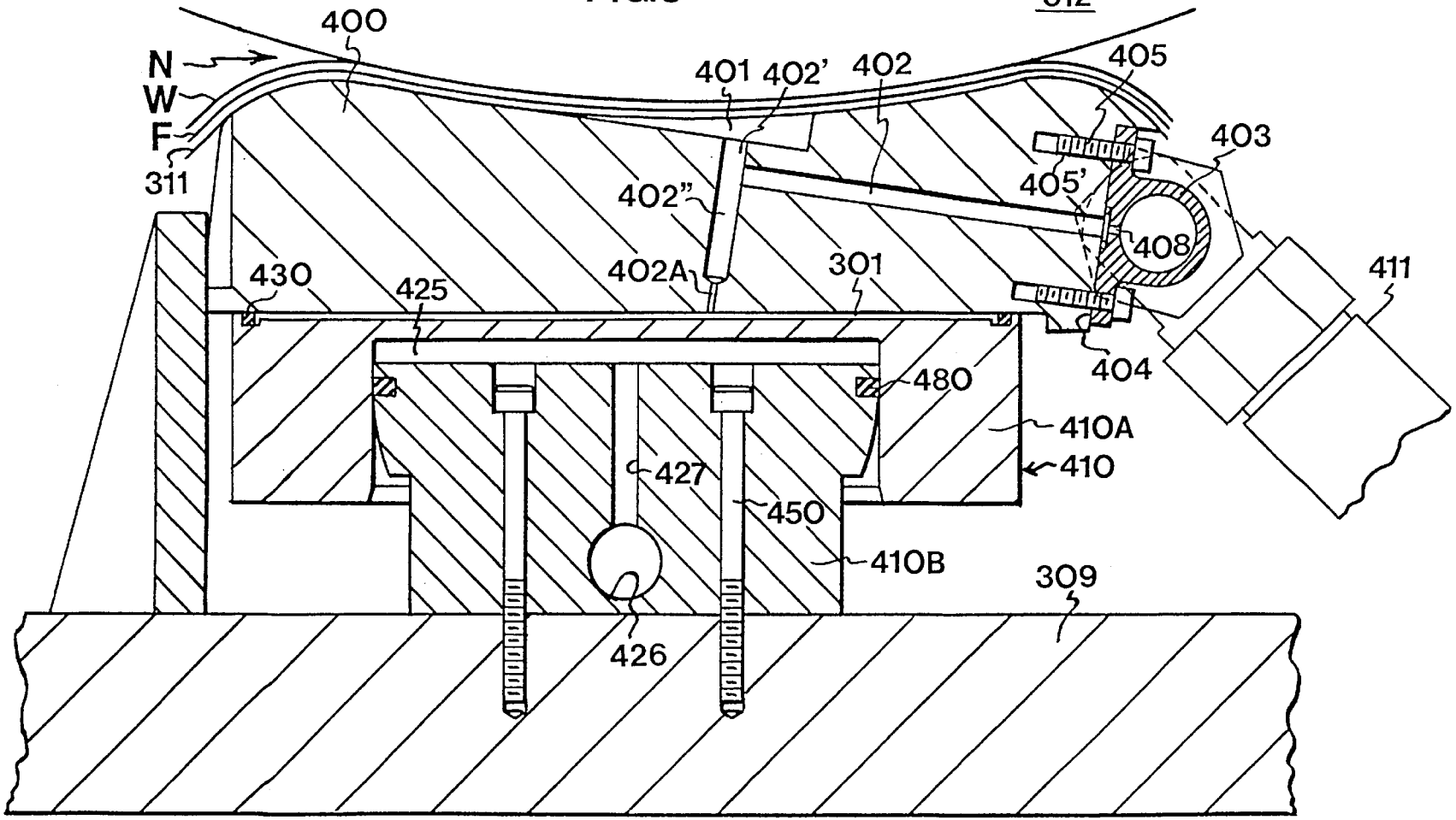
FIG. 3 is a cross-sectional view of a third preferred embodiment of the invention, showing a shoe press in which fluid is supplied from a pipe to a hydrostatic pocket formed between the press shoe and the loading cylinder and also to a hydrostatic compartment formed in the surface of the press shoe facing the counter roll.

A further preferred embodiment of the invention is depicted in FIG. 3. A sectional pipe 403 is attached to one longitudinal side edge 404 (in this case, the inlet side) of the press shoe 400 by means of screws/screw hole joints 405, 405' and supplies hydraulic fluid both to hydrostatic compartments 401 between a circulated flexible belt 311 and a press shoe 400, and to pressure chambers 301 between loading cylinders 410 and the press shoe 400. In addition to the throttles 408 in the wall of the pipe 403, which are mainly intended for the hydrostatic compartments 401, there is formed in the part 402" of the ducts 402 bored in the press shoe 400 a throttle 402A opening into the pressure chamber 301, and the ducts 402 in the press shoe have a branch 402' to the hydrostatic compartment 401. The supply of hydraulic fluid to the working chamber 425 of the loading cylinders 410 is carried out by means of a duct 426 which is bored through the piston 410B in the cross-machine direction and is common to all loading cylinders, and a duct 427 formed in the piston 410B extending in the loading direction from the horizontal duct 426. The cylinder part of the loading cylinders is designated 410A. The piston is attached to the supporting beam by means of screws 450. An O-seal between the cylinder 410A and the piston 410B is designated 480. An O-seal for the pressure chamber 301 is designated 430.

Figure 4:
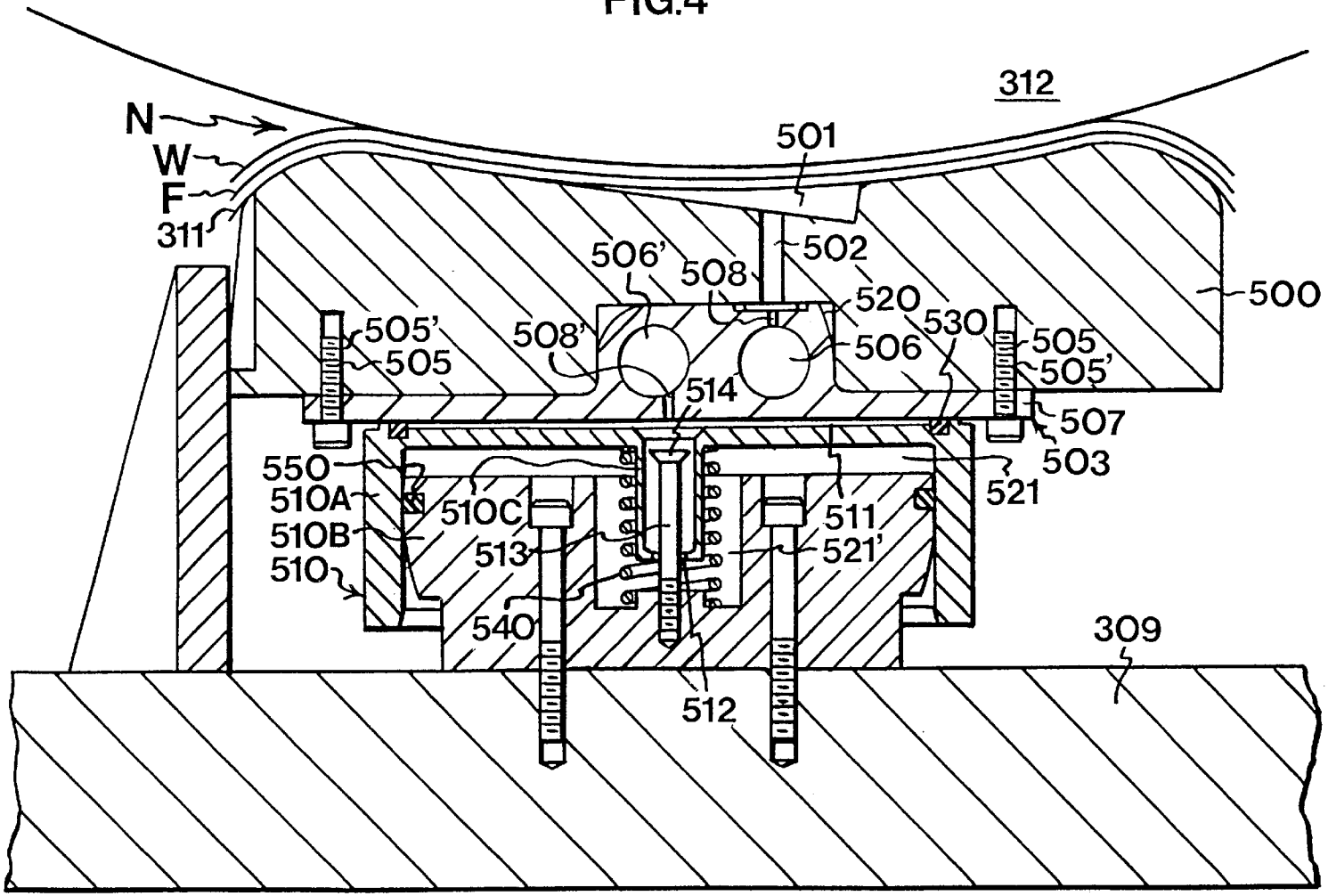
FIG. 4 is a cross-sectional view of a fourth preferred embodiment of the invention, showing a shoe press in which fluid is supplied to a hydrostatic compartment in the press shoe and to a hydrostatic pocket and working chamber of a loading cylinder by a pipe having a pair of bores, one of which supplies the hydrostatic compartment and the other of which supplies the hydrostatic pocket and working chamber.

While in the examples according FIGS. 1–3 above, sectional pipes for supplying hydraulic fluid are releasably attached to one or both longitudinal side edges of the press shoe, a pipe may alternatively be attached to the side of the press shoe facing the frame of the shoe press. FIG. 4 thus depicts another preferred embodiment of the invention having this arrangement. A sectional pipe 503 for supplying hydraulic fluid is releasably attached in a recess 520 in the side of the press shoe 500 facing the loading cylinder 510. The sectional pipe 503 contains two ducts or bores 506 and 506' which extend through the pipe 503 in the cross-machine direction. The duct 506 is connected via a passage or throttle 508 formed through the side wall of the sectional pipe 503 and a duct 502 in the press shoe 500 to a hydrostatic compartment 501 in the side of the press shoe facing the counter roll 312. The other duct 506' is connected by a passage or throttle 508' formed through the side wall of the pipe 503 to a pressure chamber 511 between the press shoe 500 and the loading cylinder 510. The pressure chamber 511 communicates with the working chamber 521 of the loading cylinder 510 via an opening 512 in a sleeve 510C connected to the cylinder 510A in which the piston 510B of the loading cylinder is slidably received. A screw 513 fixed in the piston 510B extends through the opening 512 into the interior of the sleeve 510C. The screw 513 has an enlarged head 514 which throttles the opening 512 when the loading cylinder has reached its maximum stroke in the loading direction. The sectional pipe 503 has flanges 507 by means of which it is releasably fastened to the press shoe 500, for example by screws 505 which engage screw holes 505' in the press shoe 500.

The supply of hydraulic fluid to the pipes 103, 203, 403, 503 can be effected via one end or both ends thereof. The pipes 103, 203, 403, 503 are preferably made of the same material as the press shoe, preferably aluminum or an alloy thereof, and advantageously are extruded. Any of the pipes may be supplied with hydraulic fluid by a feed pipe or hose, such as feed pipe 411 shown in FIG. 3.

It will be appreciated that the sectional pipes need not be fixed to the press shoe by means of screw joints, as described above. Various other ways of securing the pipes to the press shoe may be used, for instance, flanges in a pipe may engage in grooves formed in the press shoe. Alternatively, the pipe may be clamped onto the shoe, for example by screws which together with washers are screwed into the press shoe outside the pipe flanges, e.g. flanges 207 shown in FIG. 1, such that the screw heads and washers clamp the pipe flanges against the press shoe. The arrangement is advantageous since it allows a certain relative motion of pipe and press shoe, which may be necessary if, for instance, the pipe is selected to be made of a material other than that of the press shoe such that the pipe undergoes thermal expansion to a different degree than the shoe.

It will be appreciated that the straight sectional pipes described above are preferably common to all hydrostatic compartments/pressure chambers and loading cylinders, each of the compartments and chambers being connected via an individual duct to one of the pipes.

While the invention has been described with reference to a shoe press for use in a press section of a papermaking machine, it will be understood that the invention is also applicable to a calender section of a papermaking machine.

Many modifications and other embodiments of the invention will come to mind to one skilled in the art to which this invention pertains having the benefit of the teachings presented in the foregoing description and accompanying drawings. Therefore, it is to be understood that the invention is not to be limited to the particular embodiments illustrated and described herein, and that modifications, substitutions of equivalents, and other embodiments are intended to be included within the scope of the appended claims. Although specific terms are employed herein, they are used in a generic and descriptive sense only and not for purposes of limitation.

That which is claimed is:

1. A shoe press for pressing a running fibrous web against a counter roll, comprising:

a press shoe having a plurality of sides including a first side adapted to coact with the counter roll to form an extended nip therebetween through which the running web is carried;

a hydraulic loading cylinder adjacent a second side of the press shoe and defining a working chamber therein pressurizable with hydraulic fluid for pressing the press shoe against the counter roll;

a hydrostatic compartment formed between the second side of the press shoe and the loading cylinder and adapted to be supplied with hydraulic fluid from a hydraulic fluid source, the hydrostatic compartment being separate from the working chamber of the loading cylinder; and a duct formed in the press shoe and opening into the hydrostatic compartment, the duct being adapted to be connected to the hydraulic fluid source.

2. The shoe press of claim 1, further comprising at least one pipe adapted to be connected to the hydraulic fluid source, the pipe being attached to one of the sides of the press shoe, the pipe having a hole through a side wall thereof, and the duct having one end communicating with the hole in the pipe side wall and an opposite end opening into the hydrostatic compartment.

3. The shoe press of claim 2, wherein the press shoe includes a side edge which extends in a cross-machine direction, and wherein the pipe is releasably attached to the side edge of the press shoe.

4. The shoe press of claim 2, further comprising a plurality of loading cylinders spaced in a cross-machine direction along the press shoe and a plurality of hydrostatic compartments each formed between one of the loading cylinders and the second side of the press shoe, wherein the pipe extends along the press shoe in the cross-machine direction and includes a plurality of holes through the side wall spaced in the cross-machine direction, and wherein the press shoe includes a plurality of ducts each establishing fluid communication between one of the holes in the pipe and one of the hydrostatic compartments.

5. The shoe press of claim 2, wherein the pipe is releasably attached to the second side of the press shoe facing the loading cylinder.

6. The shoe press of claim 2, wherein the hole in the pipe comprises a throttle for regulating flow through the duct.

7. The shoe press of claim 2, wherein the duct in the press shoe connects the hole in the pipe side wall with the working chamber of the loading cylinder.

8. The shoe press of claim 7, wherein the working chamber is formed by a recess in the second side of the press shoe, and wherein the duct in the press shoe opens into the recess for supplying fluid to the working chamber.

9. The shoe press of claim 8, wherein the loading cylinder includes a piston received in the recess in the press shoe, and further comprising a hydrostatic compartment formed between the piston and a frame member of the shoe press, and a passage formed through the piston connecting the working chamber to the hydrostatic compartment between the piston and the frame member.

10. The shoe press of claim 2, further comprising at least one hydrostatic pocket formed in the first side of the press shoe facing the counter roll and wherein the pipe has two bores, one of the bores communicating with the hydrostatic pocket in the first side of the press shoe facing the counter roll and the other bore communicating with the hydrostatic compartment between the loading cylinder and the press shoe.

11. The shoe press of claim 10, further comprising a recess formed in the second side of the press shoe, and wherein the pipe is at least partially disposed in the recess.

12. The shoe press of claim 2, wherein the pipe has flanges forming attachment portions for releasably affixing the pipe to the press shoe.

13. The shoe press of claim 2, wherein the first side of the press shoe facing the counter roll includes a hydrostatic pocket formed therein, and wherein the duct includes a branched portion having a first duct portion which opens into the hydrostatic pocket in the first side of the press shoe and a second duct portion which opens into the hydrostatic compartment formed between the second side of the press shoe and the loading cylinder.

14. The shoe press of claim 13, wherein the second duct portion which opens into the hydrostatic compartment includes a throttle.

15. A shoe press for pressing a running fibrous web against a counter roll, comprising:

a press shoe having a plurality of sides including a first side adapted to coact with the counter roll to form an extended nip therebetween through which the running web is carried, and an opposite second side;

an elongate supply member releasably affixed to the second side of the press shoe and including an outer surface, the supply member including at least one bore adapted to carry hydraulic fluid;

at least one hydraulic loading cylinder adjacent the outer surface of the supply member and operable for applying force thereto so as to press the press shoe against the counter roll;

a hydrostatic pocket formed in the first side of the press shoe;

a hydrostatic compartment formed between the loading cylinder and the outer surface of the supply member;

a duct formed in the supply member connecting said at least one bore to the hydrostatic compartment; and a passage formed through the supply member and the press shoe connecting said at least one bore to the hydrostatic pocket.

16. The shoe press of claim 15, wherein the duct in the supply member which supplies the hydrostatic compartment includes a throttle.

17. The shoe press of claim 15, wherein the passage for supplying the hydrostatic pocket includes a throttle formed in the supply member.

18. The shoe press of claim 15, wherein the supply member includes a pair of bores, the duct which supplies the hydrostatic compartment being connected to one of the bores and the passage which supplies the hydrostatic pocket being connected to the other bore.

19. The shoe press of claim 15, wherein the loading cylinder includes a piston adapted to be fixed relative to the counter roll and a tubular cylinder which slidably receives the piston, the piston and cylinder defining a working chamber therebetween, the cylinder including an end wall which bounds one side of the hydrostatic compartment, the end wall including an opening therethrough which provides fluid communication between the hydrostatic compartment and the working chamber of the loading cylinder.

20. The shoe press of claim 19, wherein the piston includes a throttling member which throttles the opening in the end wall when the cylinder is in a predetermined position relative to the piston.

21. The shoe press of claim 20, wherein the cylinder end wall includes a tubular sleeve portion which projects away from the press shoe into the working chamber, the opening in the end wall being formed in the sleeve portion, and wherein the throttling member extends through the opening and has an enlarged head which closes the opening when the cylinder is in said predetermined position.

* * * * *

UNITED STATES PATENT AND TRADEMARK OFFICE
CERTIFICATE OF CORRECTION

PATENT NO. : 6,042,694

DATED : March 28, 2000

INVENTOR(S) : Brox

It is certified that error appears in the above-identified patent and that said Letters Patent is hereby corrected as shown below:

Title page, insert the following:

--Foreign Application Priority Data

Sep. 30, 1997 Sweden 9703571--.

Signed and Sealed this

Sixth Day of March, 2001

*Attest:*

Nicholas P. Godici

NICHOLAS P. GODICI

*Attesting Officer*

*Acting Director of the United States Patent and Trademark Office*